United States Patent [19]

Hotma

[11] Patent Number: 4,799,425

[45] Date of Patent: Jan. 24, 1989

[54] BOARD PRESS

[75] Inventor: Johan J. K. Hotma, Valko, Finland

[73] Assignee: Rauma-Repola Oy, Finland

[21] Appl. No.: 912,007

[22] Filed: Sep. 26, 1986

[30] Foreign Application Priority Data

Oct. 23, 1985 [FI] Finland ..... 854152

[51] Int. Cl.[4] ..... B30B 7/02

[52] U.S. Cl. ..... 100/194; 100/200

[58] Field of Search ..... 100/194, 199, 200

[56] References Cited

U.S. PATENT DOCUMENTS

| | | | |
|---|---|---|---|
| 743,368 | 11/1903 | Woerner | 100/200 |
| 2,458,858 | 1/1949 | Kelly et al. | 100/194 X |
| 2,586,474 | 2/1952 | Moore | 100/200 |
| 3,202,088 | 8/1965 | Hammon et al. | 100/200 X |
| 3,826,601 | 7/1974 | Hutter | 100/194 X |
| 4,604,949 | 8/1986 | Giese | 100/194 |

FOREIGN PATENT DOCUMENTS

| | | | |
|---|---|---|---|
| 0953384 | 11/1956 | Fed. Rep. of Germany | 100/200 |

*Primary Examiner*—Louis K. Rimrodt

[57] ABSTRACT

A board press consisting of a plurality of press plates placed one above the other and which are pressed together with the aid of pressure cylinders when pressing boards, and said press plates being interconnected with a simultaneous apparatus which maintains equal distances between press plates during movement of the press plates. The simultaneous apparatus consists of lever units at a plurality of points on both longitudinal margins of the press plates, which have been interconnected to constitute one simultaneous unit, with the aid of a rod pivotally attached to each press plate and a lever arm on the other end of said rod and a transversal turning shaft common to each pair of lever units and control rods longitudinal to the apparatus.

2 Claims, 1 Drawing Sheet

BOARD PRESS

The present invention concerns a board press consisting of a plurality of press plates positioned one above the other and which are pressed together with the aid of pressure cylinders when pressing boards, and said press plates being interconnected with a simultaneous apparatus which maintains equal distances between press plates during movements of the press plates.

All previously known types of simultaneous equipment consist of units which move the press plates of the board press by action on their corners, sides or ends maintaining equal distances between press plates. Since in this manner the simultaneous arrangement is made up by individual units and these units have no connection with each other, the whole simultaneous apparatus is unable to keep the press plates horizontal. The object of the present invention is to eliminate the drawbacks mentioned. The board press of the invention is characterized in that the simultaneous apparatus consists of lever units located at a plurality of points on both longitudinal margins of the press plates and which have been interconnected to constitute one simultaneous unit, with the aid of a rod pivotally attached to each press plate and a lever arm on the other end of said rod and with a transversal turning shaft common to each pair of lever units, and with control rods longitudinal to the apparatus. With the aid of the invention, all lever units will operate simultaneously and in equal amounts, whereby all press plates move, remaining in the same direction and horizontal, when boards are being pressed. It is possible with the board press to press even quite short blanks by closing off press cylinders on the ends of the apparatus, whereby the simultaneous apparatus will move the free parts of the press plates even though the press cylinders do not rise in this area.

An advantageous embodiment of the invention is characterized in that the lever arm is at one end pivoted to the upper part of the frame of the board press and the press plates hang down from the lever arm by mediation of rods. In this way the board press will have the simplest possible design because the press plates require no complex controlling apparatus.

Figure 1:
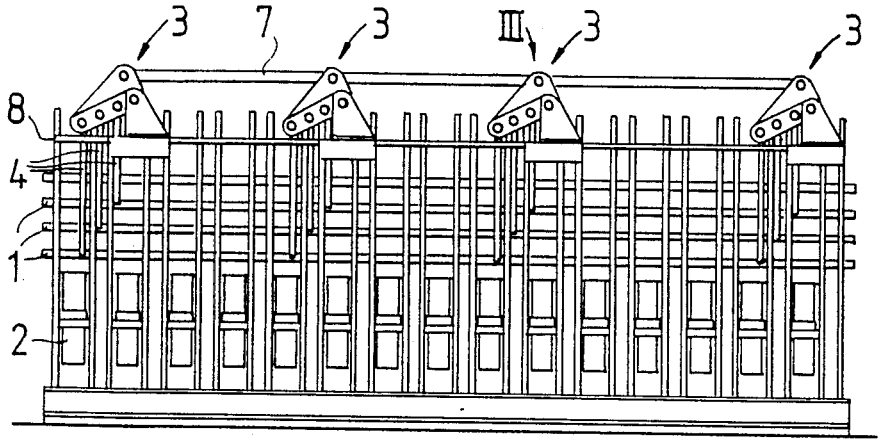

The invention is described in the following with the aid of an example, referring to the attached drawing, wherein FIG. 1 presents a board press in elevational view.

Figure 2:
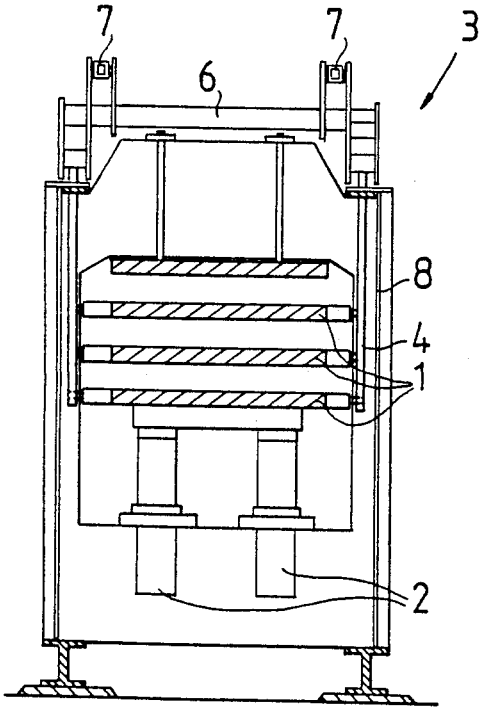

FIG. 2 presents the board press, viewed from one end.

Figure 3:
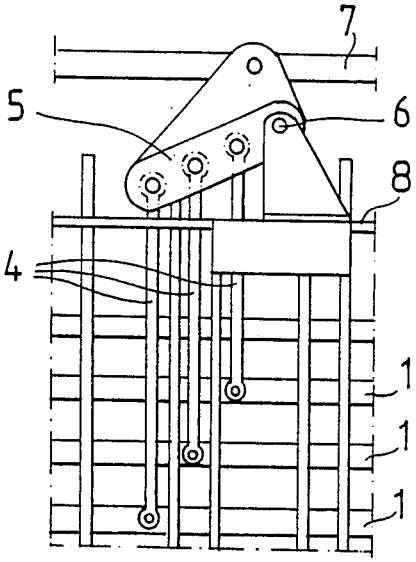

FIG. 3 presents the detail III of FIG. 1, on an enlarged scale.

The board press consists of a plurality of press plates 1 placed one over the other and which are urged together with the aid of pressure cylinders 2 when boards are being pressed. The press plates 1 are interconnected with a simultaneous apparatus which maintains equal distances between press plates during movement of the press plates. The simultaneous apparatus consists of lever units 3 at a plurality of points on both longitudinal margins of the press plates 1, these lever units being interconnected to constitute one simultaneous unit: by the aid of a rod 4 pivotally attached to each press plate 1 and a lever arm 5 on the other end of said rod and of a transversal turning shaft 6 common to each pair of lever units 3, and of control rods 7 which are longitudinal to the apparatus. The lever arm 5 is at its other end pivotally attached to the upper part of the frame 8 of the board press, and the press plates 1 hang down from the lever arm 5, suspended by the rods 4. When the press plates 1 are pressed together with the aid of pressure cylinders 2 located below, all press plates move uniformly and in horizontal position to meet each other, with the aid of the simultaneous apparatus.

It is obvious to a person skilled in the art that the invention is not confined to the examples presented in the foregoing and that it may, instead, vary within the scope of the claims set forth below.

I claim:

1. A board press comprising a plurality of press plates disposed one above the other, pressure cylinders operatively associated with said press plates for pressing said press plates together for pressing boards, and a single simultaneous apparatus interconnecting said press plates to maintain equal distances between the press plates during movement of the press plates, said single simultaneous apparatus comprising a plurality of pairs of lever units located at a plurality of points on both longitudinal margins of the press plates, each lever unit pair comprising a first lever arm pivotally mounted so that it is located at one of the longitudinal margins of said press plates and a second lever arm pivotally mounted so that it is located at the other longitudinal margin of said press plates, a rod pivotally connected to each press plate at said one longitudinal margin thereof and to said first lever arm, a rod pivotally connected to each press plate at said other longitudinal margin thereof and to said second lever arm, a transversal turning shaft common to said first and second lever arms, and longitudinal control rods disposed along said one and other longitudinal margins of said press plates, said first and second lever arms being respectively connected with a respective control rod, whereby said lever unit pairs are interconnected to constitute a single simultaneous apparatus.

2. Board press according to claim 1, wherein there is provided a frame for said board press, the first lever arm and the second lever arm each being pivotally connected to an upper part of said frame at one end of said lever arms, and wherein said press plates hang down from said lever arms by means of said rods.

* * * * *